US010092159B2

(12) United States Patent
Tchakarov

(10) Patent No.: US 10,092,159 B2
(45) Date of Patent: Oct. 9, 2018

(54) POLISHING OR GRINDING PAD ASSEMBLY

(71) Applicant: DIAMOND TOOL SUPPLY, INC., Monroe, MI (US)

(72) Inventor: Tchavdar V. Tchakarov, Monroe, MI (US)

(73) Assignee: Diamond Tool Supply, Inc., Monroe, MI (US)

( * ) Notice: Subject to any disclaimer, the term of this patent is extended or adjusted under 35 U.S.C. 154(b) by 0 days.

(21) Appl. No.: 15/690,498

(22) Filed: Aug. 30, 2017

(65) Prior Publication Data

US 2017/0361414 A1 Dec. 21, 2017

Related U.S. Application Data

(63) Continuation-in-part of application No. PCT/US2016/053355, filed on Sep. 23, 2016.
(Continued)

(51) Int. Cl.

| | |
|---|---|
| ***B24B 23/00*** | (2006.01) |
| ***A47L 11/40*** | (2006.01) |
| ***B24D 13/14*** | (2006.01) |
| ***B24B 7/18*** | (2006.01) |
| ***B24D 7/08*** | (2006.01) |
| ***B24D 11/00*** | (2006.01) |

(Continued)

(52) U.S. Cl.
CPC ..... *A47L 11/4038* (2013.01); *A47L 11/164* (2013.01); *B24B 7/186* (2013.01); *B24B 7/22* (2013.01); *B24B 41/047* (2013.01); *B24B 41/0475* (2013.01); *B24D 7/066* (2013.01); *B24D 7/08* (2013.01); *B24D 11/00* (2013.01); *B24D 13/14* (2013.01); *B24D 18/0072* (2013.01)

(58) Field of Classification Search
CPC .. B24B 23/00; B24B 7/18; B24B 7/10; B24B 7/08; B24B 11/00; B24B 18/0072
USPC ..... 451/353, 350, 359, 548
See application file for complete search history.

(56) References Cited

U.S. PATENT DOCUMENTS 2,225,193 A * 12/1940 Benner ..... B24D 5/06 16/42 R
2,425,368 A 8/1947 Doermann
(Continued)

FOREIGN PATENT DOCUMENTS

CA 162797S S 7/2015
DE 202015101442 U1 5/2015

OTHER PUBLICATIONS

ISi GmbH, The System Manufacturer, Brochure Edition 12, Jan. 2017, 83 pages.

(Continued)

*Primary Examiner* — Robert Rose
(74) *Attorney, Agent, or Firm* — Harness, Dickey & Pierce, P.L.C.

(57) ABSTRACT

A floor polishing or grinding pad assembly is provided. In one aspects a polishing or grinding pad assembly employs a flexible pad, a reinforcement layer or ring, and multiple floor-contacting tools such as disks. In yet another aspect, at least one of the floor-contacting tools has a workpiece-contacting bottom plane having angle offset from that of a base surface of the tool, a flexible pad and/or a flexible reinforcement layer. A further aspect employs a smaller set of disks alternating between and/or offset from a larger set of the disks.

53 Claims, 8 Drawing Sheets

Related U.S. Application Data

(60) Provisional application No. 62/232,123, filed on Sep. 24, 2015.

(51) Int. Cl.

| | |
|---|---|
| ***B24D 18/00*** | (2006.01) |
| ***B24B 41/047*** | (2006.01) |
| ***A47L 11/164*** | (2006.01) |
| ***B24B 7/22*** | (2006.01) |
| ***B24D 7/06*** | (2006.01) |

(56) References Cited

U.S. PATENT DOCUMENTS

| | | | | |
|---|---|---|---|---|
| 3,121,982 | A | | 2/1964 | Miller |
| 3,464,166 | A | | 9/1969 | Bouvier |
| 3,517,466 | A | * | 6/1970 | Bouvier ..... B24D 13/14 451/490 |
| 3,934,377 | A | * | 1/1976 | Tertinek ..... B24B 7/186 451/353 |
| 5,054,245 | A | * | 10/1991 | Coty ..... A47L 11/164 15/98 |
| 5,076,023 | A | | 12/1991 | Saguchi |
| 5,247,765 | A | | 9/1993 | Quintana |
| 5,567,503 | A | | 10/1996 | Sexton et al. |
| 5,586,930 | A | * | 12/1996 | Hayashi ..... B24B 7/22 451/548 |
| 5,605,493 | A | | 2/1997 | Donatelli et al. |
| 5,683,143 | A | | 11/1997 | Peterson et al. |
| 5,782,682 | A | * | 7/1998 | Han ..... B24B 7/22 451/548 |
| 6,196,911 | B1 | | 3/2001 | Preston et al. |
| 6,234,886 | B1 | | 5/2001 | Rivard et al. |
| 6,299,522 | B1 | | 10/2001 | Lee |
| 6,739,963 | B1 | | 5/2004 | Mas Garcia |
| 7,059,801 | B2 | | 6/2006 | Snyder et al. |
| 7,104,739 | B2 | | 9/2006 | Lagler |
| 7,147,548 | B1 | | 12/2006 | Mehrabi |
| 7,192,339 | B1 | | 3/2007 | Harding |
| 7,204,745 | B2 | | 4/2007 | Thysell |
| D612,874 | S | | 3/2010 | Nilsson et al. |
| 7,670,208 | B2 | | 3/2010 | Thysell et al. |
| 7,690,970 | B2 | | 4/2010 | Palushaj |
| 7,744,447 | B2 | | 6/2010 | Kodani et al. |
| 7,815,393 | B2 | | 10/2010 | Snyder et al. |
| 7,997,960 | B2 | | 8/2011 | Williams, Sr. |
| 8,147,297 | B2 | | 4/2012 | Hamm et al. |
| 8,176,909 | B2 | | 5/2012 | Ilgner |
| 8,251,780 | B2 | | 8/2012 | Ward et al. |
| 8,272,924 | B2 | | 9/2012 | Van Eijden et al. |
| 8,464,420 | B2 | | 6/2013 | Ye |
| D743,456 | S | | 11/2015 | Shinozaki |
| 9,174,326 | B2 | | 11/2015 | Ahonen |
| 9,314,899 | B2 | | 4/2016 | Puchegger et al. |
| 9,925,645 | B2 | | 3/2018 | Song et al. |
| 2005/0164620 | A1 | | 7/2005 | Amamoto |
| 2007/0254568 | A1 | | 11/2007 | Park |
| 2007/0292207 | A1 | | 12/2007 | Reed et al. |
| 2008/0311826 | A1 | | 12/2008 | Thysell |
| 2009/0190999 | A1 | | 7/2009 | Copoulos |
| 2009/0191799 | A1 | | 7/2009 | Rivard |
| 2010/0136889 | A1 | | 6/2010 | Kilgren et al. |
| 2011/0195644 | A1 | | 8/2011 | Gallup et al. |
| 2011/0223845 | A1 | | 9/2011 | Van Der Veen et al. |
| 2011/0300784 | A1 | | 12/2011 | Tchakarov et al. |
| 2012/0270483 | A1 | | 10/2012 | Bae et al. |
| 2013/0225051 | A1 | | 8/2013 | Vankouwenberg |
| 2013/0324021 | A1 | | 12/2013 | Ryan |
| 2016/0136772 | A1 | | 5/2016 | Littlefield et al. |
| 2016/0221155 | A1 | | 8/2016 | Song et al. |
| 2017/0129067 | A1 | | 5/2017 | Young |

OTHER PUBLICATIONS

Diamond Tool Supply, Inc., "Monroe Floor Polishing Systems," www.diamondtoolsupply.com, published prior to Sep. 24, 2015, 14 pages.

Diamond Tool Supply, Inc., Various polishing and grinding parts, www.diamondtoolsupply.com, published prior to Sep. 24, 2015, 26 pages.

Wagman Metal Products Inc, "Concrete Finishing Tools," www.WagnamMetal.com, published prior to Sep. 14, 2016, 24 pages.

"Confidential/experimental sale from Diamond Tool Supply, Inc. to Wagman Metal Products on Sep. 1, 2015," 2 pages.

"Diamond Tools for Construction Stone," EHWA Diamond Ind. Co. Ltd. Catalogue, Published 2016, 60 pages.

* cited by examiner

POLISHING OR GRINDING PAD ASSEMBLY

CROSS-REFERENCE TO RELATED APPLICATIONS

This application is a continuation-in-part of PCT International Patent Application serial number PCT/US2016/053355, filed on Sep. 23, 2016, which claims the benefit of U.S. Provisional Application No. 62/232,123 filed on Sep. 24, 2015, both of which are incorporated by reference herein.

BACKGROUND AND SUMMARY

The disclosure relates generally to a pad assembly and more particularly to a floor polishing or grinding pad assembly.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patents and patent publication numbers: 2011/0300784 entitled "Flexible and Interchangeable Multi-Head Floor Polishing Disk Assembly" which was invented by Tchakarov et al. and published on Dec. 8, 2011; U.S. Pat. No. 9,174,326 entitled "Arrangement For Floor Grinding" which issued to Ahonen on Nov. 3, 2015; U.S. Pat. No. 6,234,886 entitled "Multiple Abrasive Assembly and Method" which issued to Rivard et al. on May 22, 2001; U.S. Pat. No. 5,605,493 entitled "Stone Polishing Apparatus and Method" which issued to Donatelli et al. on Feb. 25, 1997; and U.S. Pat. No. 5,054,245 entitled "Combination of Cleaning Pads, Cleaning Pad Mounting Members and a Base Member for a Rotary Cleaning Machine" which issued to Coty on Oct. 8, 1991. All of these patents and the patent publication are incorporated by reference herein.

Notwithstanding, improved floor polishing and grinding performance is desired. Furthermore, some of these prior constructions exhibit uneven wear in use which prematurely destroy the pads or cause inconsistent polishing or grinding.

In accordance with the present invention, a floor polishing or grinding pad assembly is provided. In one aspect, a polishing or grinding pad assembly employs a flexible pad, a reinforcement layer or ring, and multiple floor-contacting tools such as disks. In another aspect, a workpiece polishing or grinding pad assembly includes a flexible and rotatable pad, and abrasive tools of different sizes coupled to a workpiece-facing surface of the pad. In yet another aspect, at least one of the floor-contacting tools has a workpiece-contacting bottom plane with a tapered angle offset from that of a base surface of the tool, a flexible pad and/or a flexible reinforcement layer. A further aspect employs a smaller set of disks alternating between and/or offset from a larger set of the disks. A method of making and using a flexible pad employing multiple polishing or grinding tools of different sizes or patterns is also presented.

The present pad assembly is advantageous over traditional devices. For example, some of the disk configurations, such as disk angles and/or offset placement of disks, of the present pad assembly advantageously create more consistent wear characteristics when polishing or grinding, thereby increasing their useful life and consistency of polishing or grinding. These angles cause more even inner and outer wear of the floor-facing side of the pad assembly. The angles additionally create more consistent floor-contact pressure between a middle and periphery during rotational use. Furthermore, the present pad assembly advantageously allows greater floor contact with the pad within a centralized area generally surrounded by the disks, in various of the present aspects, which is expected to improve polishing or grinding performance. The alternating large and small tools and/or differently patterned tools, coupled to the pad also provide differing polishing or grinding characteristics without the need to change pad assemblies during use. Additional advantages and features of the present invention will be readily understood from the following description, claims and appended drawings.

DETAILED DESCRIPTION

Figure 1:
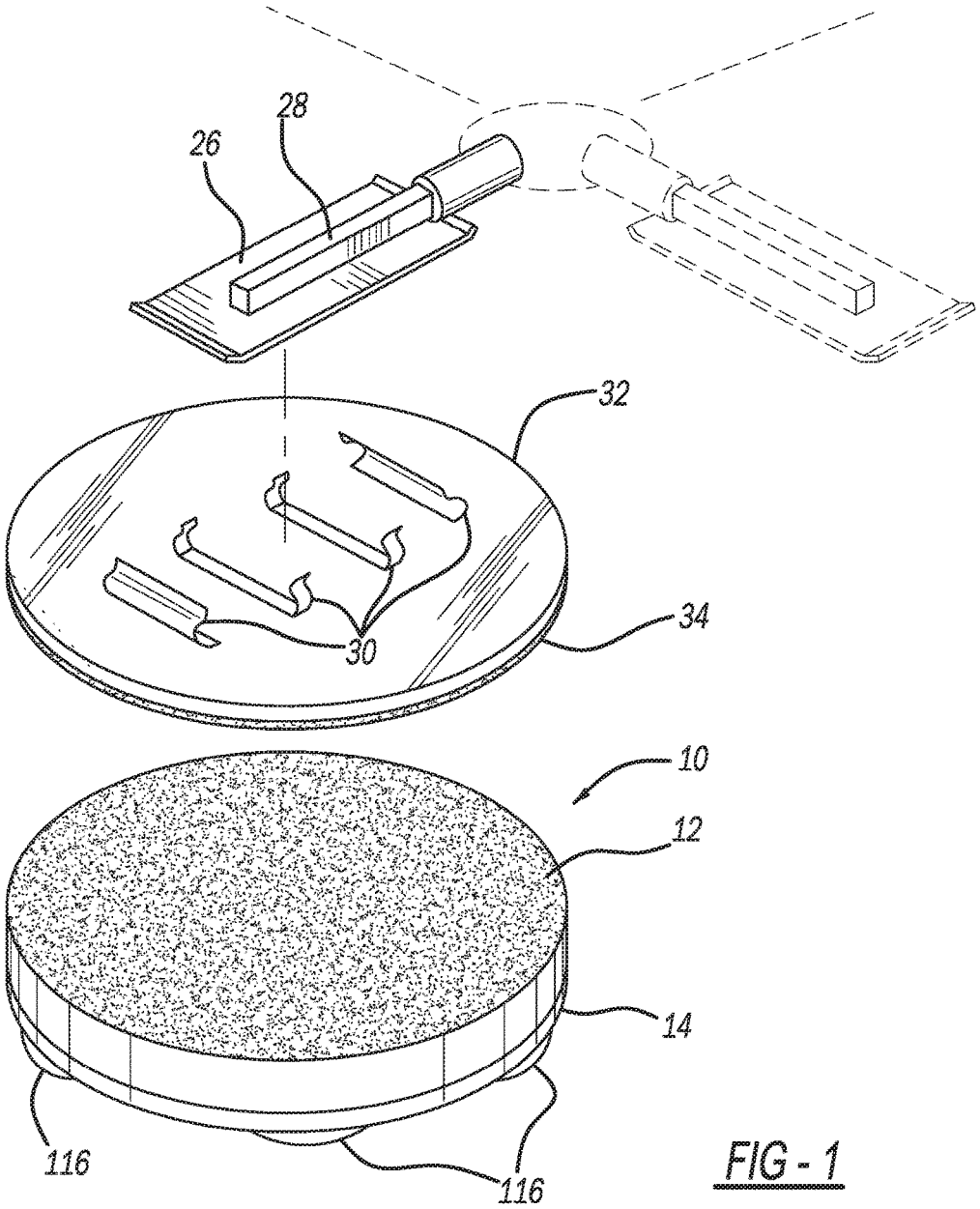
FIG. 1 is a partially exploded top perspective view showing a first embodiment of a pad assembly and a powered machine.
Figure 2:
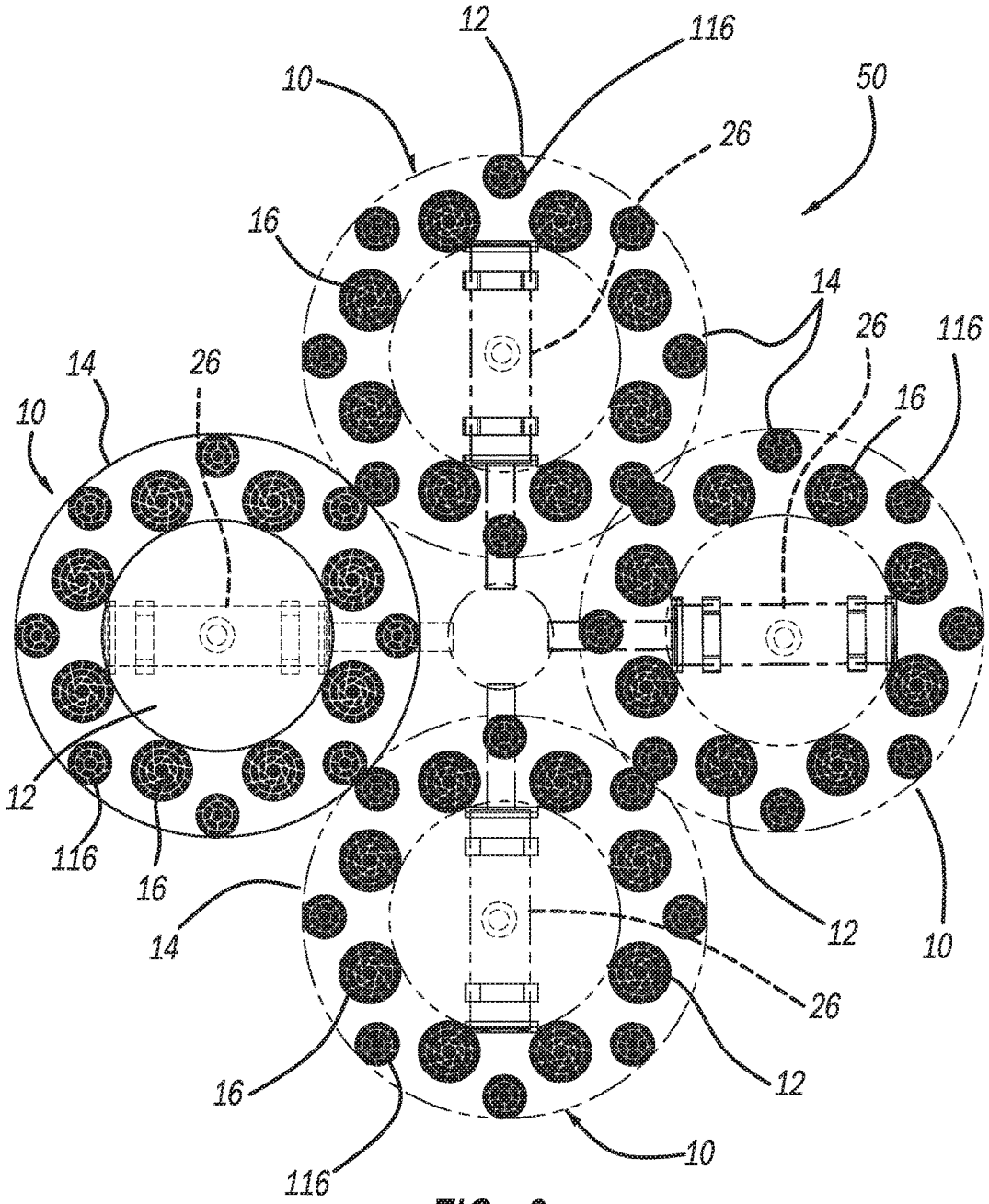
FIG. 2 is a diagrammatic bottom elevational view showing the first embodiment pad assembly and powered machine.
Figure 3:
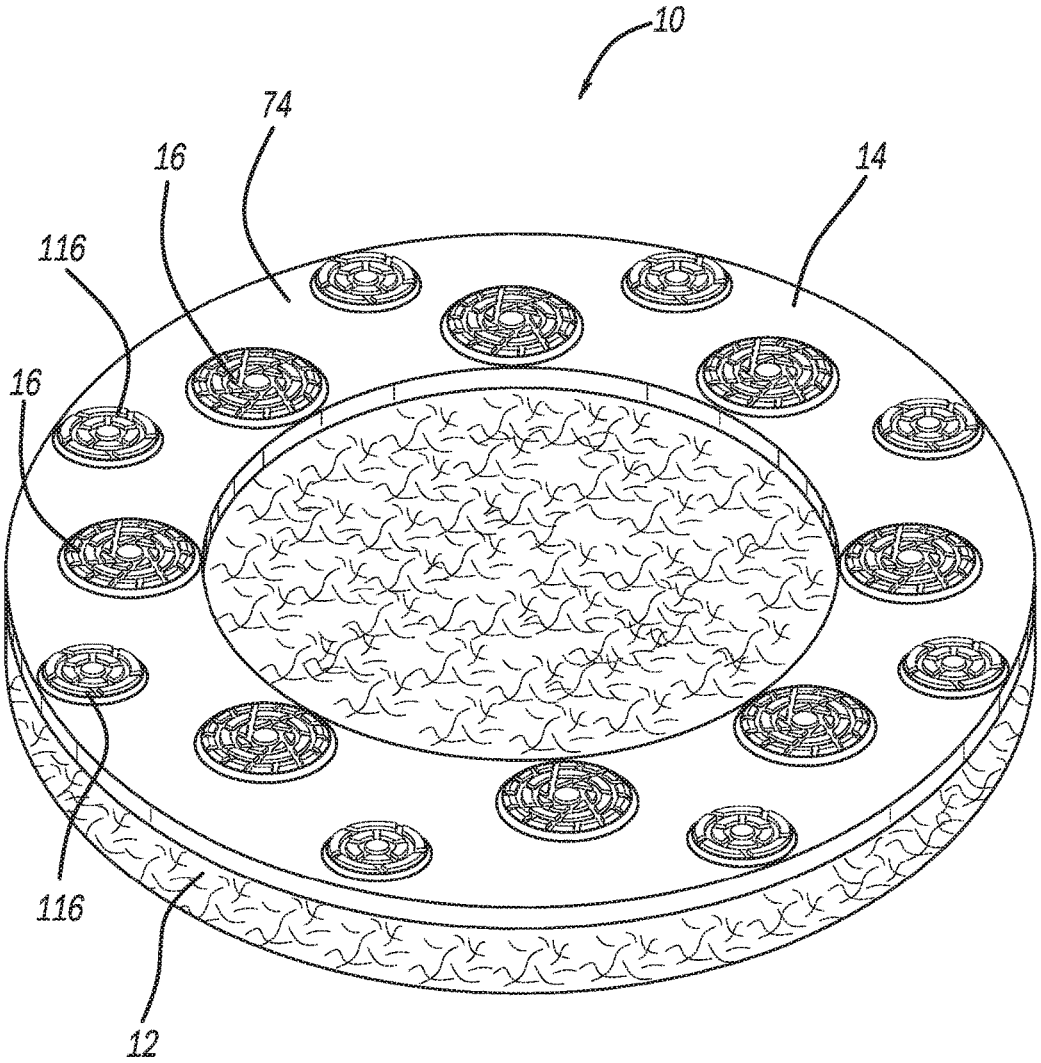
FIG. 3 is a bottom perspective view showing the first embodiment pad assembly.
Figure 4:
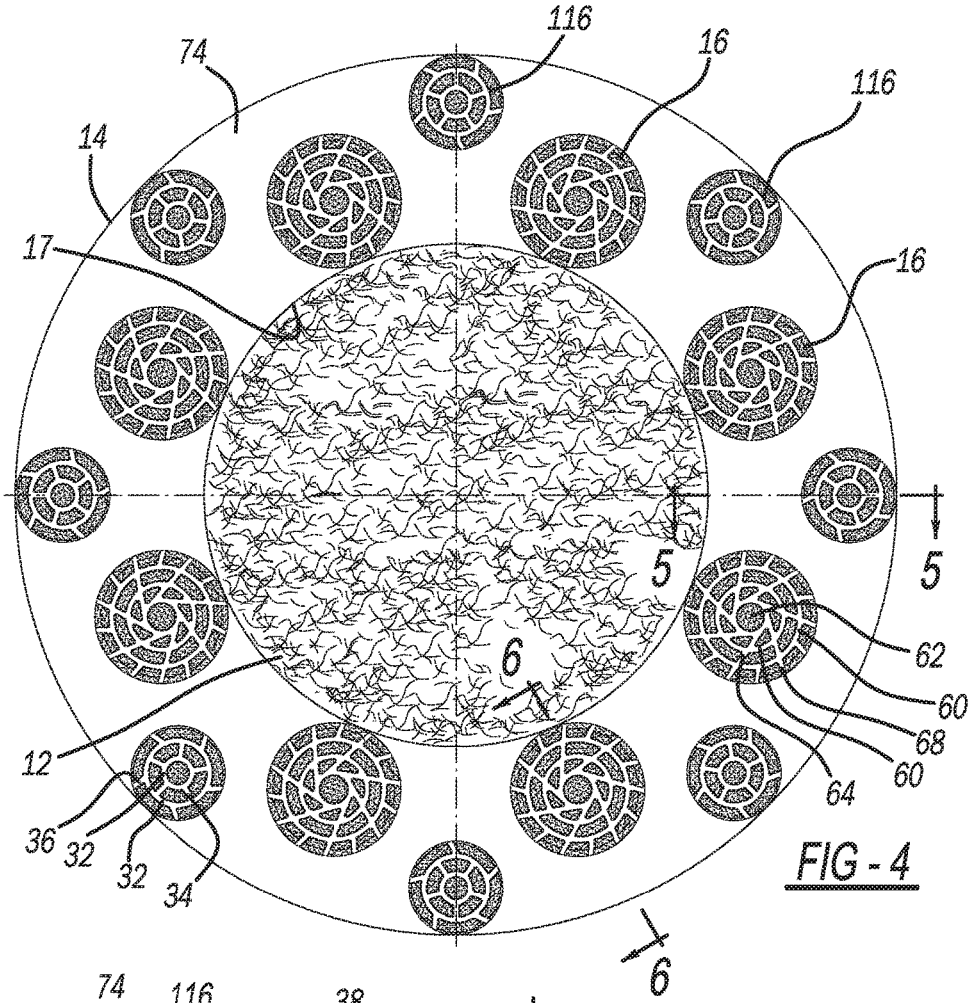
FIG. 4 is a bottom elevational view showing the first embodiment pad assembly.
Figure 5:
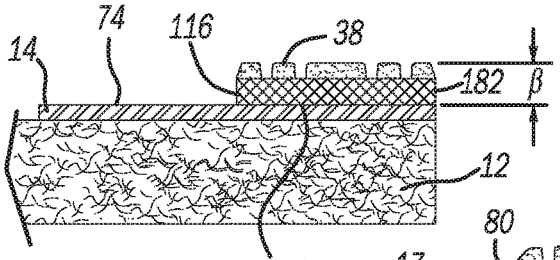
FIG. 5 is a cross-sectional view, taken along line 5-5 of FIG. 4, showing the first embodiment pad assembly.
Figure 6:
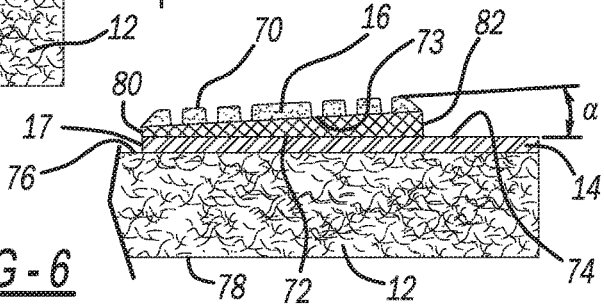
FIG. 6 is a cross-sectional view, taken along line 6-6 of FIG. 4, showing the first embodiment pad assembly.

A pad assembly 10 according to one embodiment is shown in FIGS. 1-6. Pad assembly 10 may be used for grinding or polishing composite workpiece surfaces, such as a concrete floor. Pad assembly 10 includes a wear-resistant base pad 12, which may be a porous, fibrous, flexible, and deformable material, including polymer, foam, felt or other durable but flexible material. Base pad 12 is generally circular, having a peripheral diameter of at least 7 inches, more preferably 14 inches, and a thickness of at least 0.5 inches. Of course, base pad 12 could be made in other sizes.

A reinforcement ring or layer 14 is secured to one side of base pad 12, such as by adhesive. The reinforcement ring 14 is generally annular having a central opening 18 with a diameter for example, of approximately 8 inches. Reinforcement ring 14 is preferably metallic spring steel, but may alternately be a rubber or plastic material having a thickness greater than zero and up to 0.125 inch. Ring 14 is thinner than pad 10. Reinforcement ring or layer 14 reinforces and adds some stiffness and toughness to the outer portion of pad 12, however, ring or layer 14 allows some flexibility to pad assembly 10 so it can flex with and follow any floor imperfections thereby producing uniform floor contact for polishing or grinding.

A circular internal edge 17 of reinforcement ring 14 defines a central opening or hole 18 which exposes a central surface 20 of base pad 12. Central surface 20 of base pad 12 may be impregnated with diamond particles or other abrasive materials. Central surface 20 of the base pad 12 may also be painted a color indicating a quality of the pad assembly 10, such as the coarseness. Base pad 12 land ring 14 preferably have circular peripheral surfaces 19 and 21, respectively.

A plurality of alternating large and small sized abrasive tools or floor-contacting disks 16 and 116, respectively, are secured to the workpiece-facing surface of reinforcement ring 14. In the example shown, abrasive tools 16 are approximately 2 inch disks of diamond particles in a polymeric resin matrix. Furthermore, disks 116 are each preferably 1.5 inches in peripheral diameter made of the diamond and polymeric materials. In the example shown, eight of each type or set of the large and small abrasive tools or disks 16 and 116 are spaced apart and secured about reinforcement ring 14. Tools or disks 16 and 116 are adhesively bonded to ring 14 or fastened by crimping posts extending from a backside of the disks into holes in the ring.

As shown in FIGS. 3-6, one set versus the other set of abrasive tools or disks 16 and 116 may have differing characteristics, such as size, shape, abrasive pattern or material. For example, an abrasive pattern of disks 116 consists of multiple concentric circles 32, preferably two, intersected by straight radial spokes 34. Spokes 36 linearly and diagonally extend outwardly from an outermost circle to the circular periphery. The spokes are equally spaced about the entire disk. Spokes 34 are aligned with a centerline. Circles 32 and spokes 34 and 36 are preferably grooves or channels molded below a generally flat nominal surface 38 which contacts against the floor during use. A center 40 is solid and without a hole therein, although in an alternate arrangement a through hole may be provided at the center but some of the functional advantages may not be fully achieved.

Differently, the abrasive pattern of disks 16 employs multiple circular grooves 60 which are concentrically arranged above a solid center 62. At least three and more preferably seven linearly elongated spokes 64 outwardly radiate from an innermost circular groove to a peripheral tapered circular groove, however, an innermost end of each spoke 64 is offset from a centerline. Additional shortened spokes 68 outwardly radiate between outermost groove and the next groove internal therefrom. The shortened spokes 68 are radially aligned with a disk centerline.

These different disk patterns are expected to perform differently depending upon whether polishing or grinding use is desired and also depending upon the floor materials and characteristics to be worked upon by the present pad assembly 10. For example, a liquid polishing or grinding solution is typically employed between the disks and the floor. Therefore, the angle, size, spacing and curvature of the channels or grooves somewhat dictates the flow of the solution and abrasive action between the disks and floor when the pad assembly is being rotated by the powered machine. Moreover, these pattern characteristics also assist the pads in riding over, or alternately abrading, floor surface imperfections such as localized bumps or ridges therein. It should also be appreciated that polishing or grinding pastes or powders may alternately be employed instead of liquid solutions. Notwithstanding, these pattern shapes also have an ornamental aspect.

Figure 7:
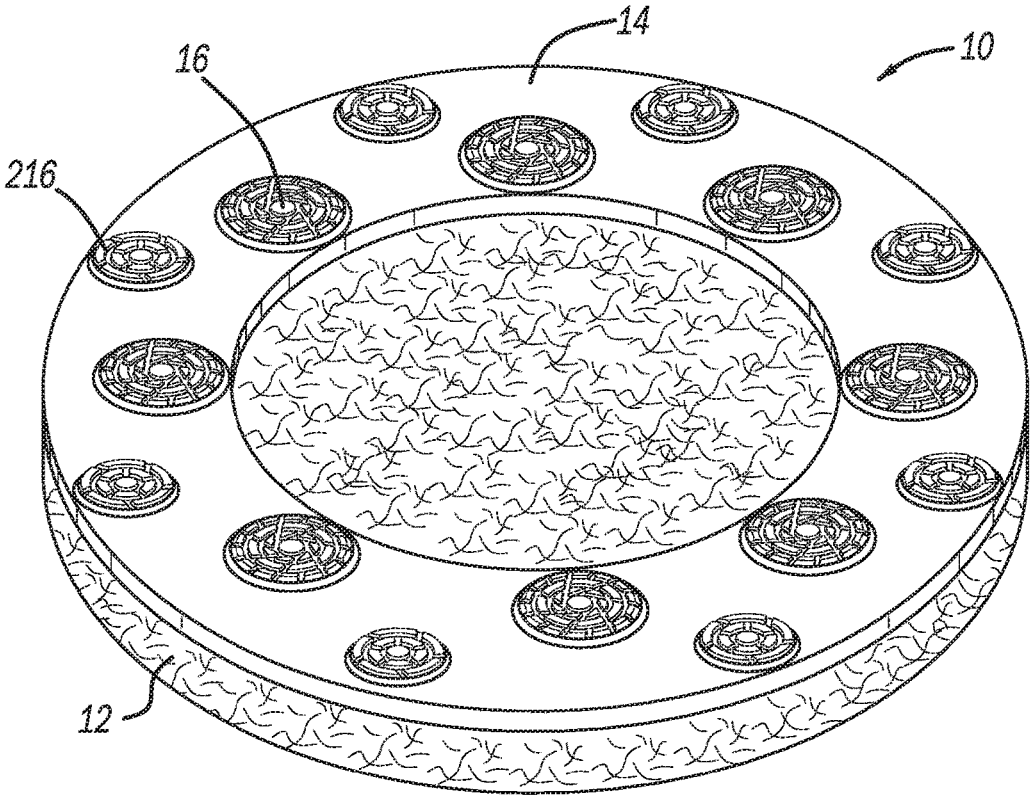
FIG. 7 is a bottom perspective view showing a second embodiment of the pad assembly.
Figure 9:
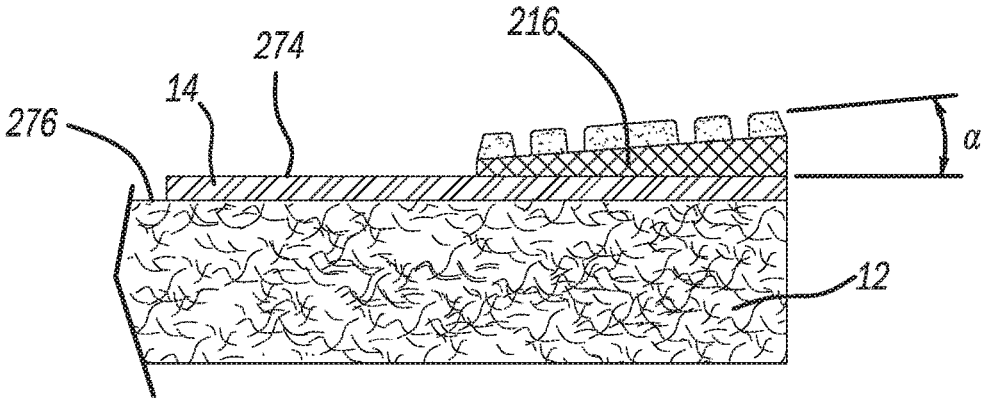
FIG. 9 is a cross-sectional view, taken along line 9-9 of FIG. 8, showing the second embodiment pad assembly.
Figure 8:
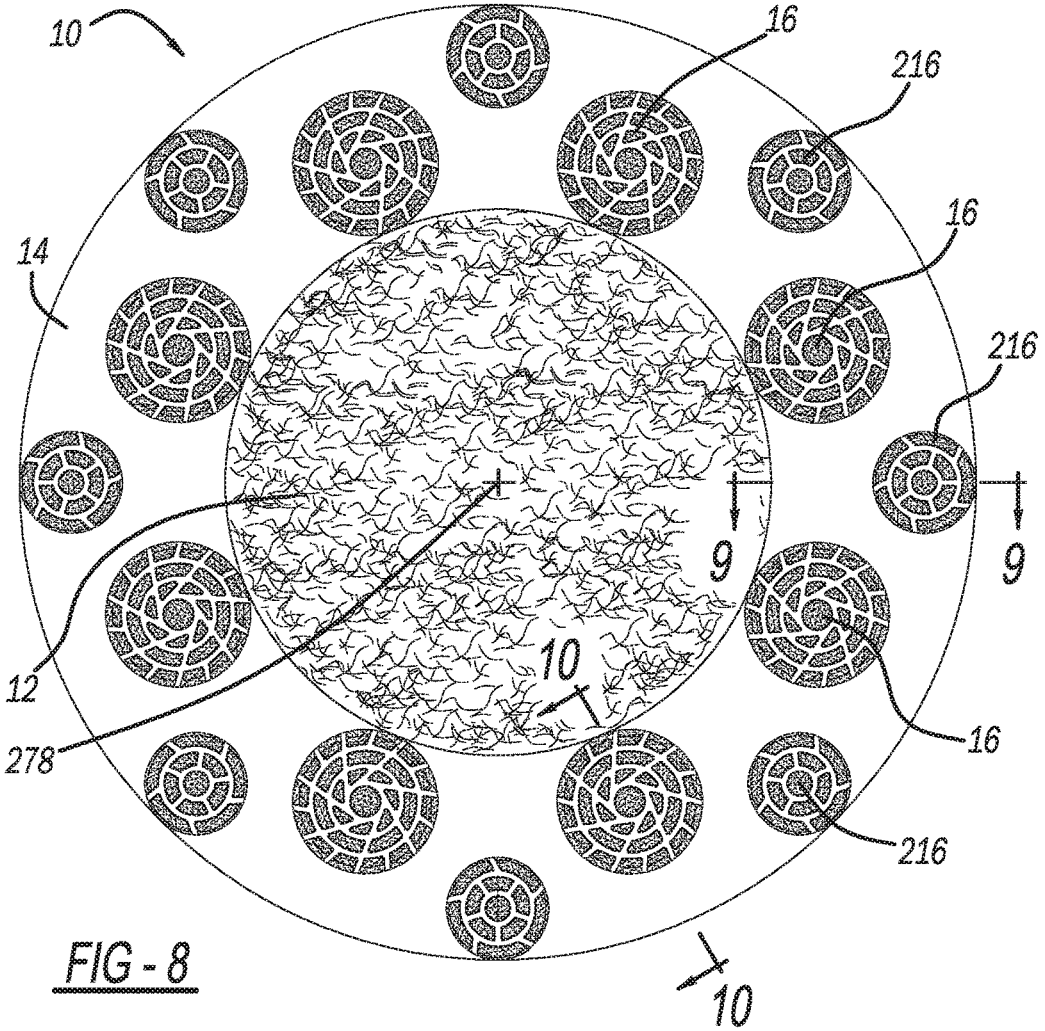
FIG. 8 is a bottom elevational view showing the second embodiment pad assembly.
Figure 10:
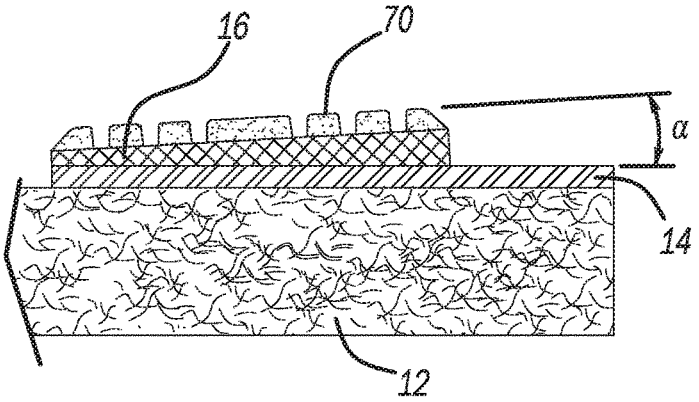
FIG. 10 is a cross-sectional view, taken along line 10-10 of FIG. 8, showing the second embodiment pad assembly.
Figure 11:
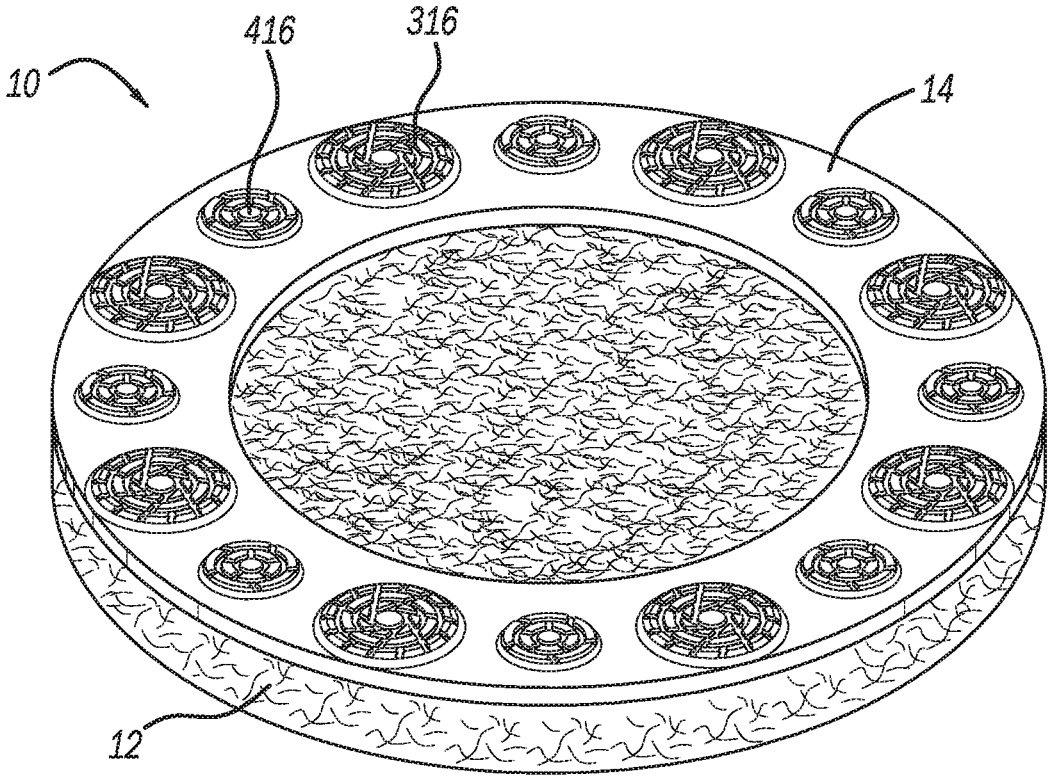
FIG. 11 is a bottom perspective view showing a third embodiment of the pad assembly.
Figure 13:
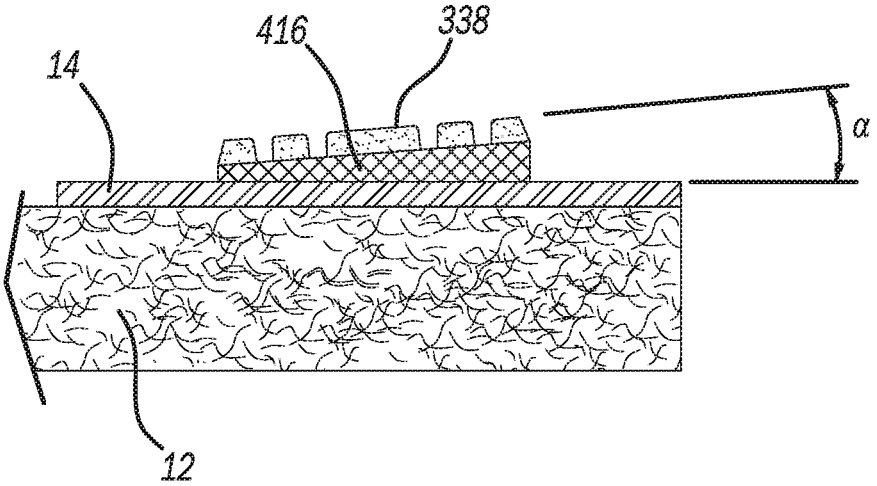
FIG. 13 is a cross-sectional view, taken along line 13-13 of FIG. 12, showing the third embodiment pad assembly.

FIG. 7 shows an innovative way that polishing pad 10 could be secured to a paddle 26 of a rotating arm 28 of an electric motor powered floor polishing or grinding machine 50. A hard rubber or plastic disk 32 includes a plurality of clips 30 for releasably securing to paddle 26. A panel 34 of hook-and-loop fasteners (e.g. Velcro®) may be secured to the bottom of disk 32 and can be removably secured to the fibrous base pad 12. FIG. 8 is a bottom view of machine 50, wherein a plurality of polishing pads 10 would be secured for rotation about a center axis. Alternate powered machines may be used to rotate pad assembly 10 such as those disclosed in the Background section hereinabove.

It is noteworthy that inner edge 17 defining the hole of ring 14 has a diameter or linear dimension x which is larger than a linear dimension y of a solid section of ring 14 which is adjacent to one side of the hole. More preferably, hole dimension x is a least twice as large as ring dimension y and more preferably, dimension x is 9 inches. The hole relationship of $x>y$ is expected to improve floor contact by the fibrous central portion of pad 12 within the hole defined by internal edge 17 of ring 14.

Each disk 16 of this embodiment has an offset angle $\alpha$ between a nominal generally flat, floor-contacting surface 70 of disk pattern 30 and an upper base surface 72 (upper when in the functional position with surface 70 against the floor). Angle $\alpha$ is at least 2 degrees, more preferably at least 2-10 degrees, or 4 degrees, and even more preferably 4-10 degrees. Surface 70 is preferably parallel to a nominal surface 73 defined by the most depressed portions of the circular and radial grooves. Upper surface 72 of the base of each disk is preferably parallel to the mating lower surface 74 of reinforcement ring 14 and also both lower and upper surfaces 76 and 78, respectively, of pad 12. An apex of angle $\alpha$ and thinnest portion is preferably adjacent an inboard edge 80 of each disc while the thickest portion of each disk 16 is preferably at an outboard edge 82.

Each of the outer second set of disks 116 has its nominal floor-contacting surface or plane 38 at a dimensional relationship or zero angle $\beta$ generally parallel to a top surface 172 of its base which is also parallel to lower surface 74 of ring 14 and the top and bottom surfaces of fibrous pad 12. An outermost edge 182 of each of the second disks 116 is generally aligned with the peripheral surfaces of ring 14 and fibrous pad 12. Moreover, each second disk 116 has a diameter less than that of first disk 16, and more preferably 1.5 inches. The larger disks 16 and smaller disks 116 are laterally or circumferentially offset from each other in an alternating manner.

The angle $\alpha$ of disks 16 (of both this and the other offset angled embodiments disclosed herein) compensates for the inherent uneven wear that occurs when the powered machine rotates pad assembly 10 while the machine also tends to provide more downward force closer to the centerline than at the peripheral portions of the pad assembly. This is expected to improve longevity and polishing/grinding consistency when in use. Furthermore, the disk and ring configurations of this embodiment are ideally suited for a pre-polishing step between grinding and polishing, although certain ornamental aspects of this construction are also achieved.

Reference is now made to FIGS. 7-10. This exemplary embodiment employs a fibrous pad 12, reinforcement ring 14 and inner disks 16 like that of FIGS. 4 and 6. Outer and smaller abrasive disks 216 have a bottom or working disk nominal surface angle α offset angled by 2-10 degrees from nominal floor-facing ring and pad surfaces 274 and 276, and more preferably at least 4 degrees. Thus, both sets of alternating disks 16 and 216 have the same tapered angle with their thinner or apex side inwardly facing toward a rotational centerline 278 of pad assembly 10. Alternately, the taper angle α may differ between the inner and outer disks.

FIGS. 11-14 illustrate another embodiment of workpiece polishing or grinding pad assembly 10. The flexible and rotatable pad 12 and optional metallic reinforcement ring layer 14 are the same as the prior embodiments of FIGS. 3 and 7. This configuration, however, includes alternating abrasive tools or disks of differing characteristics. More specifically, disks 316 have a larger circular peripheral dimension (such as diameter) than do the alternating smaller disks 416. Both sets of disks preferably have the offset taper angle α for the floor-contacting nominal surfaces 338 and 370, but either may alternately have a parallel floor-facing bottom surface-to-pad angle β.

Figure 12:
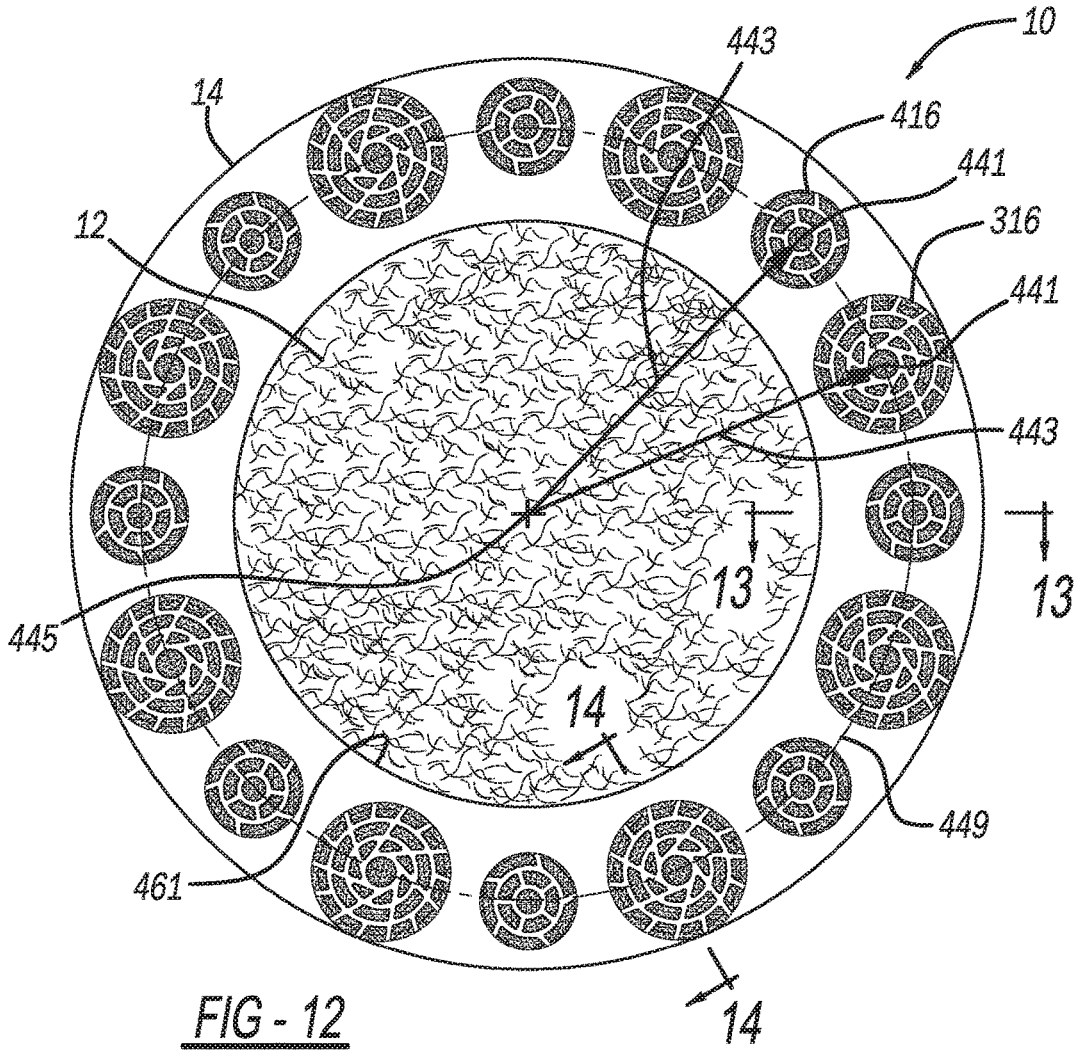
FIG. 12 is a bottom elevational view showing the third embodiment pad assembly.
Figure 14:
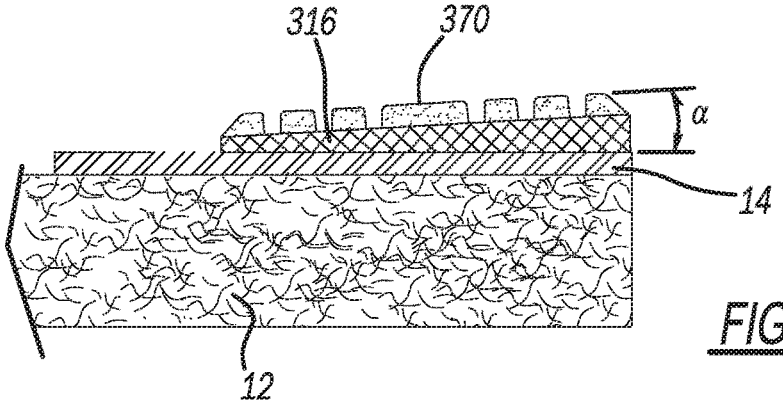
FIG. 14 is a cross-sectional view, taken along line 14-14 of FIG. 12, showing the third embodiment pad assembly.

Each of the large and small disks 316 and 416, respectively, has a centerpoint 441 that is the same radial distance 443 away from a rotational centerline 445 of pad assembly 10. Thus, all of the large and small tools or disks are arcuately aligned on the same true view circle 449 as shown in FIG. 12. This arrangement creates an aesthetically pleasing ornamental design. Furthermore, the abrasive patterns of the large disks may be different than or the same as those of the adjacent small disks. In this construction, all of the disks are spaced away from an inner edge 451 of ring 14 defining a central hole through which a central portion of pad 12 is exposed to allow this portion of the pad to abrade against the floor.

While various embodiments have been disclosed, it should be appreciated that additional variations of the pad assembly are also envisioned. For example, while preferred dimensions have been disclosed hereinabove, it should alternately be appreciated that other dimensions may be employed; for example a peripheral pad diameter of at least 10 inches may be employed and disk diameters of 0.5-2.5 inches may also be employed. Moreover, circular peripheral shapes for the pad, reinforcement ring and disks are preferred, however, other arcuate or even generally polygonal peripheral shapes may be used although certain of the present advantages may not be fully realized. It is also envisioned that the alternating small and large abrasive tools (such as disks) may be directly attached to the pad without a reinforcement ring therebetween. Furthermore, at least three large abrasive tools may alternate with at least three small abrasive tools, although the larger quantities shown and described hereinabove will likely enjoy better polishing and grinding performance. It is also possible to employ more than two sets of alternating disks, each set having at least one different characteristic. While certain materials have been disclosed it should be appreciated that alternate materials may be used although all of the present advantages may not be fully achieved. It is also noteworthy that any of the preceding features may be interchanged and intermixed with any of the others; by way of example and not limitation, any of the disclosed reinforcement ring shapes and/or sizes may be employed with or without angular disks, with any of the aforementioned disk patterns and/or with any of the disk-to-disk positioning. Accordingly, any and/or all of the dependent claims may depend from all of their preceding claims and may be combined together in any combination. Variations are not to be regarded as a departure from the present disclosure, and all such modifications are entitled to be included within the scope and spirit of the present invention.

The invention claimed is:

1. A pad assembly comprising:

a flexible and rotatable pad;

a first set of abrasive tools coupled to the pad; and at least a second set of abrasive tools coupled to the pad, one of the sets of tools having a different characteristic than another of the sets of tools;

wherein the different characteristic of the tools is an abrasive pattern on a floor-facing bottom surface thereof.

2. The pad assembly of claim 1, further comprising a reinforcement layer located between the tools and the pad, the reinforcement layer being flexible and attached to a workpiece-facing surface of the pad.

3. The pad assembly of claim 2 wherein:

a peripheral surface of the pad is circular;

a periphery of the reinforcement layer is circular and substantially aligned with the peripheral surface of the pad; and a centerpoint of the tools are all substantially equally spaced away from a centerline of the pad.

4. The pad assembly of claim 2, wherein the reinforcement layer is metallic, and the pad includes diamonds and fibers.

5. The pad assembly of claim 1, wherein:

there are at least three of the first set of tools which are disks with a circular periphery; and an apex of a tapered abrasive surface angle relative to a floor-facing pad surface, is closer to an inboard versus outboard edge.

6. The pad assembly of claim 1, wherein the different characteristic of the tools also is peripheral size.

7. A pad assembly comprising:

a flexible and rotatable pad;

a first set of abrasive tools coupled to the pad; and at least a second set of abrasive tools coupled to the pad, one of the sets of tools having a different characteristic than another of the sets of tools;

wherein at least one of the tools includes a floor-abrading surface including arcuate channels outwardly radiating between a centerline and periphery of the tool, the pattern further including circular channels intersecting the curved and radiating channels, the tool including a solid center without an aperture therein, and the tools all including a polymeric material.

8. The pad assembly of claim 7, wherein the different characteristic of the tools is an abrasive pattern on a floor-facing bottom surface thereof.

9. The pad assembly of claim 1, wherein the pad assembly is rotatable by a floor grinding or polishing machine, and an outer diameter of the pad is at least seven inches.

10. The pad assembly of claim 1, wherein the tools are disks with each of the first set being larger in diameter than a diameter of the second set, and the disks of the first set alternate with the disks of the disks of the second set.

11. The pad assembly of claim 1, wherein the tools of the first set are radially offset a greater distance from a pad rotational axis than those of the second set.

12. A pad assembly comprising:

a fibrous pad;

a first set of disks coupled to the pad, each of the first disks including a floor-contacting nominal surface;

a second set of disks coupled to the pad, each of the second disks including a floor-contacting nominal surface;

a reinforcement layer located between the disks and the pad;

a peripheral surface of the pad being circular;

a periphery of the reinforcement layer being circular and substantially aligned with the peripheral surface of the pad;

the first and second disks having a circular periphery;

wherein there are at least four of the first disks;

wherein there are at least four of the second disks; and a characteristic of the second disks being different from that of the first disks, wherein the characteristic is at least one of: (a) a size of the disks, (b) a groove pattern of the floor-contacting nominal surfaces, and (c) an angle of the floor-contacting nominal surface relative to a floor-facing surface of the fibrous pad.

13. A pad assembly comprising:

a fibrous pad;

a first set of disks coupled to the pad, each of the first disks including a floor-contacting nominal surface;

a second set of disks coupled to the pad, each of the second disks including a floor-contacting nominal surface; and a characteristic of the second disks being different from that of the first disks, the characteristic including an angle of the floor-contacting nominal surface relative to a floor-facing surface of the fibrous pad.

14. A pad assembly comprising:

a fibrous pad;

a first set of disks coupled to the pad, each of the first disks including a floor-contacting nominal surface;

a second set of disks coupled to the pad, each of the second disks including a floor-contacting nominal surface; and a characteristic of the second disks being different from that of the first disks, the characteristic being a floor-abrading groove pattern.

15. The pad assembly of claim 12, wherein the characteristic includes at least two of (a), (b) and (c).

16. A pad assembly comprising:

a fibrous pad;

a first set of disks coupled to the pad, each of the first disks including a floor-contacting nominal surface;

a second set of disks coupled to the pad, each of the second disks including a floor-contacting nominal surface;

a characteristic of the second disks being different from that of the first disks;

a reinforcement layer located between the disks and the pad;

the internal edge of the reinforcement layer being circular such that the reinforcement layer has an annular shape; and the pad being flexible and including diamond abrasive particles.

17. The pad assembly of claim 12, wherein centerpoints of the first and second sets of disks are all equally located the same distance away from a rotational centerline of the pad.

18. The pad assembly of claim 13, further comprising a reinforcement layer located between the disks and the pad.

19. The pad assembly of claim 18 wherein:

a peripheral surface of the pad is circular;

a periphery of the reinforcement layer is circular and substantially aligned with the peripheral surface of the pad;

the first and second disks having a circular periphery;

wherein there are at least four of the first disks;

wherein there are at least four of the second disks; and wherein the characteristic is at least one of: (a) a size of the disks, (b) a groove pattern of the floor-contacting nominal surfaces, and (c) an angle of the floor-contacting nominal surface relative to a floor-facing surface of the fibrous pad.

20. The pad assembly of claim 13, wherein the angle of the first disks is 2-10 degrees and the angle of the second disks is 0 degrees.

21. The pad assembly of claim 20, wherein centerpoints of the second disks are further away from a rotational centerline of the fibrous pad than are centerpoints of the first disks.

22. The pad assembly of claim 12, wherein the characteristic includes diameters of the disks.

23. The pad assembly of claim 12, wherein the second disks are of a smaller diameter, are further away from a centerline of the fibrous pad than are the first disks, and have a different abrasive pattern than the first disks.

24. The pad assembly of claim 12, wherein the first disks circumferentially alternate with the second disks.

25. The pad assembly of claim 12, further comprising a central area of the pad being exposed through the hole of the reinforcement layer such that a linear dimension of the central area within the hole is greater than a linear dimension of one side of the reinforcement layer between the hole and a periphery thereof.

26. A pad assembly comprising:

(a) a flexible pad including a substantially circular periphery;

(b) a first set of abrasive tools including a floor-grinding or polishing patterned surface on a bottom thereof, the first set including at least three of the tools;

(c) at least a second set of abrasive tools including a floor-grinding or polishing patterned surface on a bottom thereof, the second set including at least three of the tools;

(d) the tools of the sets alternating with each other and being spaced apart from each other around the pad to which they are coupled;

(e) the first set of tools having a different size or patterned surface than that of the second set of tools; and (f) a centerpoint of all of the tools being substantially equally spaced away from a rotational centerline of the pad.

27. The pad assembly of claim 26, further comprising a reinforcement layer located between the tools and the pad, the reinforcement layer being flexible and attached to a floor-facing surface of the pad.

28. The pad assembly of claim 27, wherein the reinforcement layer is metallic, and the pad includes diamonds and fibers.

29. The pad assembly of claim 26, wherein the first and second sets of tools have the different size which includes a different peripheral dimension.

30. A pad assembly comprising:

(a) a flexible pad including a substantially circular periphery;

(b) a first set of abrasive tools including a floor-grinding or polishing patterned surface on a bottom thereof, the first set including at least three of the tools;

(c) at least a second set of abrasive tools including a floor-grinding or polishing patterned surface on a bottom thereof, the second set including at least three of the tools;

(d) the tools of the sets alternating with each other and being spaced apart from each other around the pad to which they are coupled; and (e) the first set of tools having a different patterned surface than that of the second set of tools, the different patterned surface including a different quantity of circular grooves and a different quantity of spoked grooves.

31. The pad assembly of claim 26, wherein a nominal plane at a bottom of the patterned surface of at least one of the sets of tools has a tapered angle relative to a nominal plane of a floor-facing bottom surface of the pad.

32. The pad assembly of claim 26, wherein a centerpoint of all of the tools are substantially equally spaced away from a rotational centerline of the pad.

33. The pad assembly of claim 26, wherein the pad assembly is rotatable by a floor grinding or polishing machine, and an outer diameter of the pad is at least seven inches.

34. The pad assembly of claim 30, wherein the tools of the first set are radially offset a greater distance from a pad rotational axis than those of the second set.

35. A method of making a floor grinding or polishing pad assembly, the method comprising:

(a) attaching a flexible reinforcement layer to a surface of a flexible pad;

(b) attaching at least three abrasive disks of a first type to the reinforcement layer;

(c) attaching at least three abrasive disks of a second type to the reinforcement layer, with the different types of disks being spaced apart from and alternating with each other;

(d) a central, diamond and fiber portion of the pad being exposed through a central hole in the reinforcement layer, which is metallic;

(e) the disks of the types differing in size and abrasive surface pattern; and (f) the pad being adapted to rotate about a centerline.

36. The method of claim 35, further comprising flowing a liquid polishing or grinding solution, when rotating the pad assembly by a powered machine, dictated at least in part by different floor-contacting angles of the first disks versus the second disks.

37. The method of claim 35, further comprising flowing a liquid polishing or grinding solution, when rotating the pad assembly by a powered machine, dictated at least in part by different floor-contacting channel spacing of the first disks versus the second disks.

38. The method of claim 35, further comprising flowing a liquid polishing or grinding solution, when rotating the pad assembly by a powered machine, dictated at least in part by different floor-contacting channel curvature of the first disks versus the second disks.

39. The method of claim 35, further comprising externally exposing the reinforcement on a floor-facing surface of the pad.

40. The pad assembly of claim 7, further comprising a metallic reinforcement layer externally exposed on a floor-facing surface of the pad, and the pad including diamonds and fibers.

41. The pad assembly of claim 7, further comprising:

a reinforcement layer located between the tools and the pad, the reinforcement layer being flexible and attached to a workpiece-facing surface of the pad;

the pad assembly being rotatable by a floor grinding or polishing machine; and an outer diameter of the pad being at least seven inches.

42. The pad assembly of claim 16, wherein centerpoints of the first and second sets of disks are all equally located the same distance away from a rotational centerline of the pad.

43. The pad assembly of claim 16, wherein the characteristic includes an angle of the floor-contacting nominal surface relative to a floor-facing surface of the fibrous pad.

44. The pad assembly of claim 16, wherein centerpoints of the second disks are further away from a rotational centerline of the fibrous pad than are centerpoints of the first disks.

45. The pad assembly of claim 16, wherein the characteristic is a floor-abrading groove pattern.

46. The pad assembly of claim 16, further comprising a central area of the pad being exposed through the hole of the reinforcement layer such that a linear dimension of the central area within the hole is greater than a linear dimension of one side of the reinforcement layer between the hole and a periphery thereof.

47. The pad assembly of claim 16, wherein the pad assembly is rotatable by a floor grinding or polishing machine, and an outer diameter of the pad is at least seven inches.

48. The pad assembly of claim 13, wherein the pad assembly is rotatable by a floor grinding or polishing machine, and an outer diameter of the pad is at least seven inches.

49. The pad assembly of claim 13, wherein the second disks are of a smaller diameter, are further away from a centerline of the fibrous pad than are the first disks, and have a different abrasive pattern than the first disks.

50. The pad assembly of claim 13, wherein the first disks circumferentially alternate with the second disks.

51. The pad assembly of claim 30, further comprising a reinforcement layer located between the tools and the pad, the reinforcement layer being flexible and attached to a floor-facing surface of the pad.

52. The pad assembly of claim 51, wherein the reinforcement layer is metallic, and the pad includes diamonds and fibers.

53. The pad assembly of claim 30, wherein the pad assembly is rotatable by a floor grinding or polishing machine, and an outer diameter of the pad is at least seven inches.

* * * * *